US008151931B2

(12) United States Patent
Eaton et al.

(10) Patent No.: US 8,151,931 B2
(45) Date of Patent: Apr. 10, 2012

(54) ACOUSTIC NOISE CONTROL IN HEATING OR COOLING SYSTEMS

(75) Inventors: Erroll Eaton, Carrollton, TX (US); Mark Cree Jackson, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 12/818,632

(22) Filed: Jun. 18, 2010

(65) Prior Publication Data

US 2011/0308883 A1 Dec. 22, 2011

(51) Int. Cl.
*E04F 17/04* (2006.01)

(52) U.S. Cl. ..... 181/224; 181/225; 181/212

(58) Field of Classification Search ..... 181/212, 181/224, 225

See application file for complete search history.

(56) References Cited

U.S. PATENT DOCUMENTS

| | | | | |
|---|---|---|---|---|
| 3,947,148 | A * | 3/1976 | Holt | 415/119 |
| 4,266,602 | A * | 5/1981 | White et al. | 165/124 |
| 4,279,325 | A * | 7/1981 | Challis | 181/211 |
| 5,326,317 | A * | 7/1994 | Ishizu et al. | 454/354 |
| 6,688,424 | B1 * | 2/2004 | Nakada et al. | 181/224 |
| 6,892,851 | B2 * | 5/2005 | Lee | 181/224 |
| 6,945,355 | B2 * | 9/2005 | Ludwig et al. | 181/224 |
| 7,006,639 | B2 * | 2/2006 | Hobelsberger | 381/96 |
| 7,717,229 | B2 * | 5/2010 | Putnam | 181/213 |
| 2006/0272886 | A1 * | 12/2006 | Mueller | 181/224 |
| 2008/0207111 | A1 * | 8/2008 | Stroehla | 454/262 |
| 2009/0183943 | A1 * | 7/2009 | Leistner et al. | 181/224 |
| 2009/0235879 | A1 * | 9/2009 | Ikeda et al. | 123/41.49 |
| 2010/0018798 | A1 * | 1/2010 | Jeon et al. | 181/225 |
| 2010/0077755 | A1 * | 4/2010 | Jangili et al. | 60/725 |

* cited by examiner

*Primary Examiner* — Forrest M Phillips

(57) ABSTRACT

A heating or cooling system comprising a powered fan held in a duct assembly. The powered fan generates acoustic noise when blowing air. The system also comprises an acoustic wave modulator held in the duct assembly. The acoustic wave modulator has one or more fins and is configured to reduce turbulence of the air traveling through the duct assembly.

19 Claims, 6 Drawing Sheets

ACOUSTIC NOISE CONTROL IN HEATING OR COOLING SYSTEMS

TECHNICAL FIELD

This application is directed, in general, to heating or cooling systems, and more specifically, to acoustic noise control in such systems.

BACKGROUND

It is desirable to reduce acoustic noise which occurs as a byproduct of operating heating or cooling systems, such as heating, ventilating and air conditioning (HVAC) systems or refrigeration systems. A substantial amount of the acoustic noise associated with the circulation of air in such systems, e.g., for the operation of a fan of the system. Typical means of fan noise reduction are accomplished with the design of efficient fan systems that produce high airflow with minimal fan speeds.

SUMMARY

One embodiment of the present disclosure is a heating or cooling system. The system comprises a powered fan held in a duct assembly. The powered fan generates acoustic noise when blowing air. The system also comprises an acoustic wave modulator held in the duct assembly. The acoustic wave modulator has one or more fins and is configured to reduce turbulence of the air traveling through the duct assembly.

Another embodiment of the present disclosure is a method of manufacturing a heating or cooling system. The method comprises providing a duct assembly, and coupling a powered fan to the duct assembly. The powered fan generates acoustic noise when blowing air. The method further comprises coupling an acoustic wave modulator having one or more fins to the duct assembly. The acoustic wave modulator is configured to reduce turbulence of the air traveling through the duct assembly.

Another embodiment of the present disclosure is a method of using a heating or cooling system. The method comprises blowing air using a powered fan held in a duct assembly, wherein the powered fan generates acoustic noise. The method further comprises transmitting the air through the duct assembly to an acoustic wave modulator held in the duct assembly, the acoustic wave modulator having one or more fins. The method further comprises reducing turbulence of the air thereby reducing the acoustic noise.

BRIEF DESCRIPTION OF THE DRAWINGS

Reference is now made to the following descriptions taken in conjunction with the accompanying drawings, in which.

DETAILED DESCRIPTION

One embodiment of the present disclosure is a heating or cooling system. The term, "or," as used herein, refers to a non-exclusive or, unless otherwise indicated. In some cases, the heating or cooling system is a heating, ventilating and air conditioning (HVAC) system. In other cases, the heating or cooling system is a refrigeration system. Based on the present disclosure one of ordinary skill in the art would appreciate other embodiments that the system could have.

Figure 1:
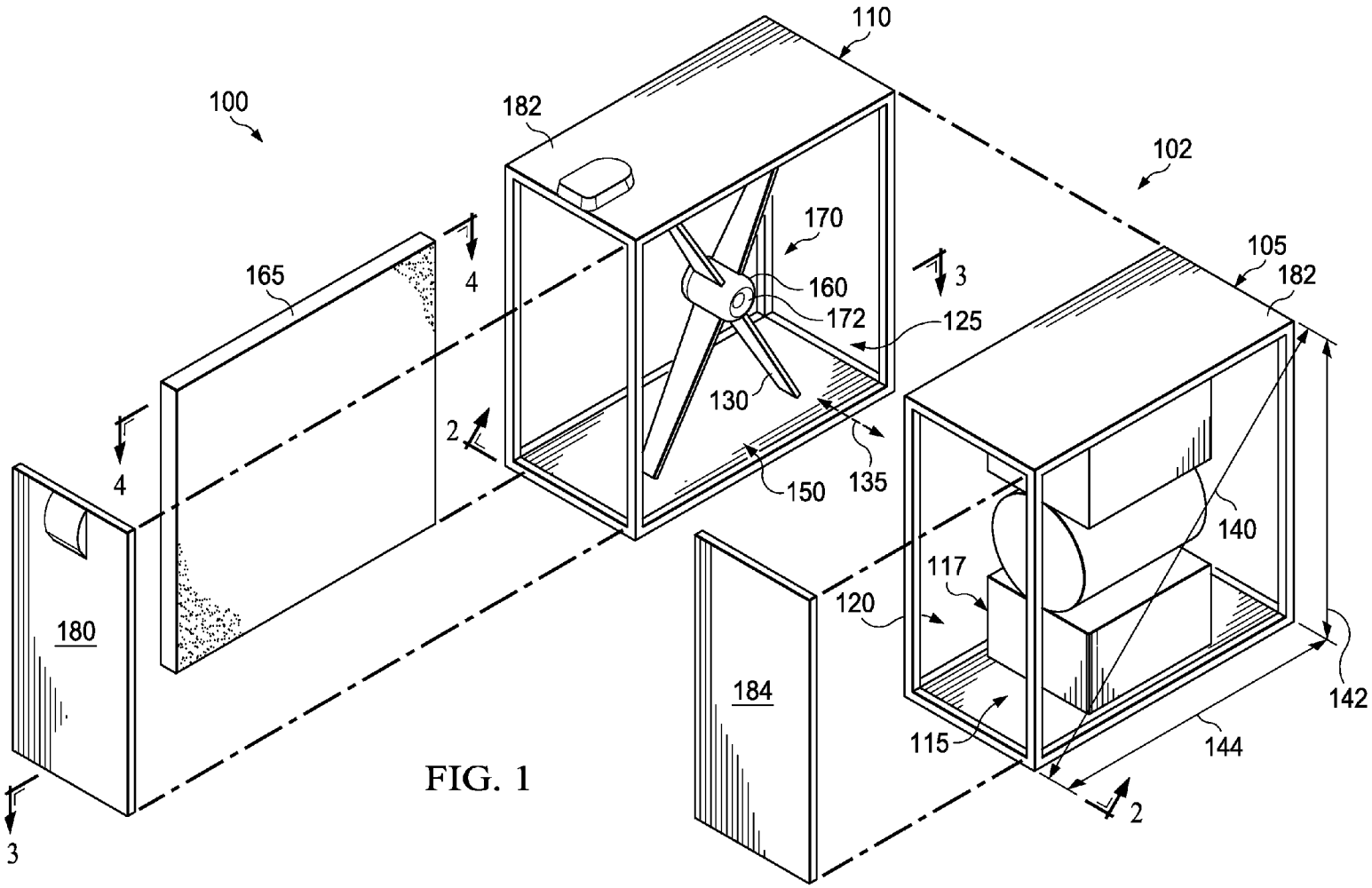
FIG. 1 presents an exploded perspective view of selected portions of an example embodiment a heating or cooling system of the disclosure.

FIG. 1 presents an exploded perspective view of selected portions an example embodiment of a heating or cooling system 100 of the disclosure. Some overlying features (e.g., some of the unit's top and side panel covers) are not shown so as to more clearly depict internal features of the system 100.

Figure 2:
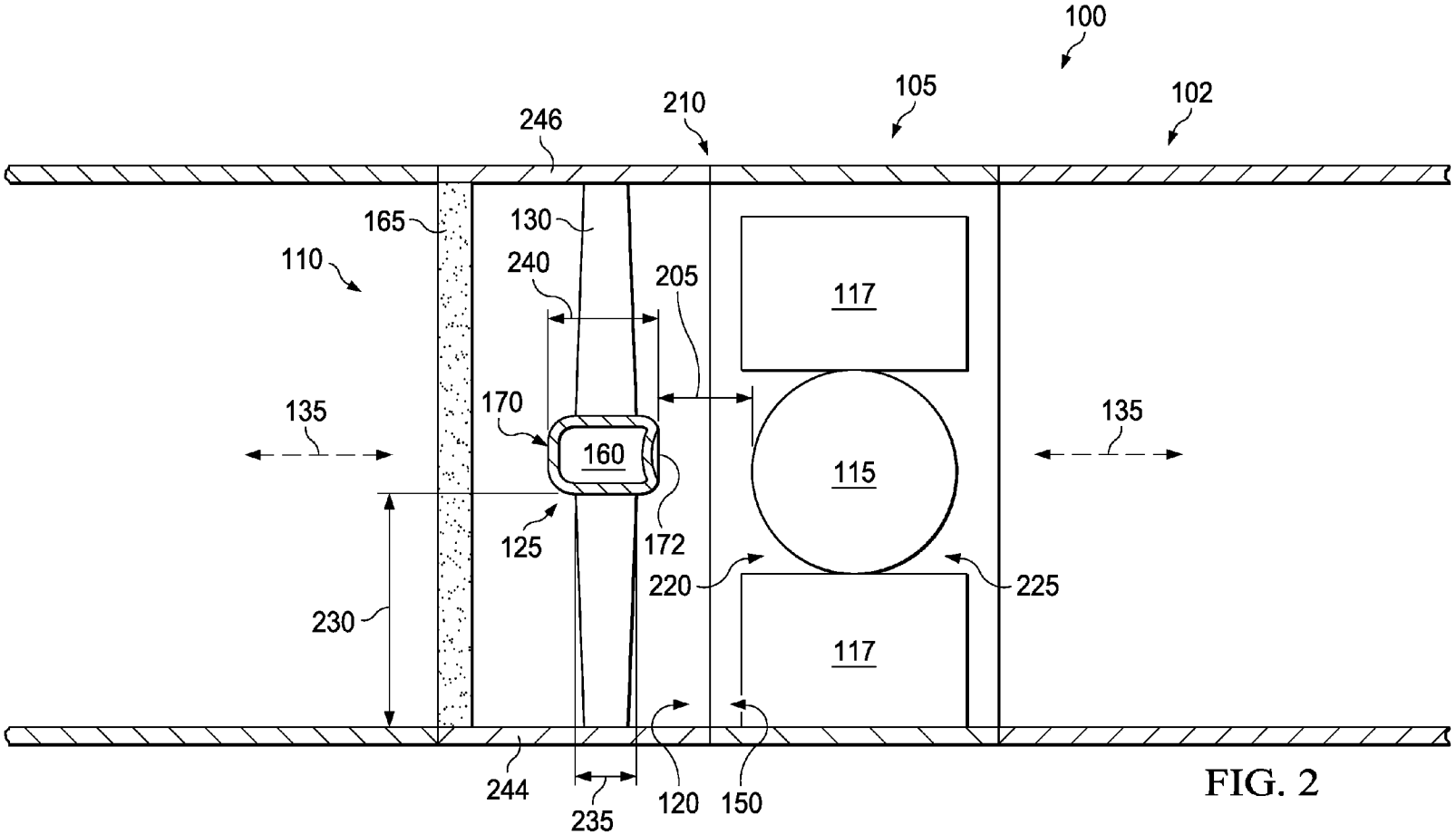
FIG. 2 presents a cross-sectional view of the example system presented in FIG. 1, along view line 2-2.
Figure 3:
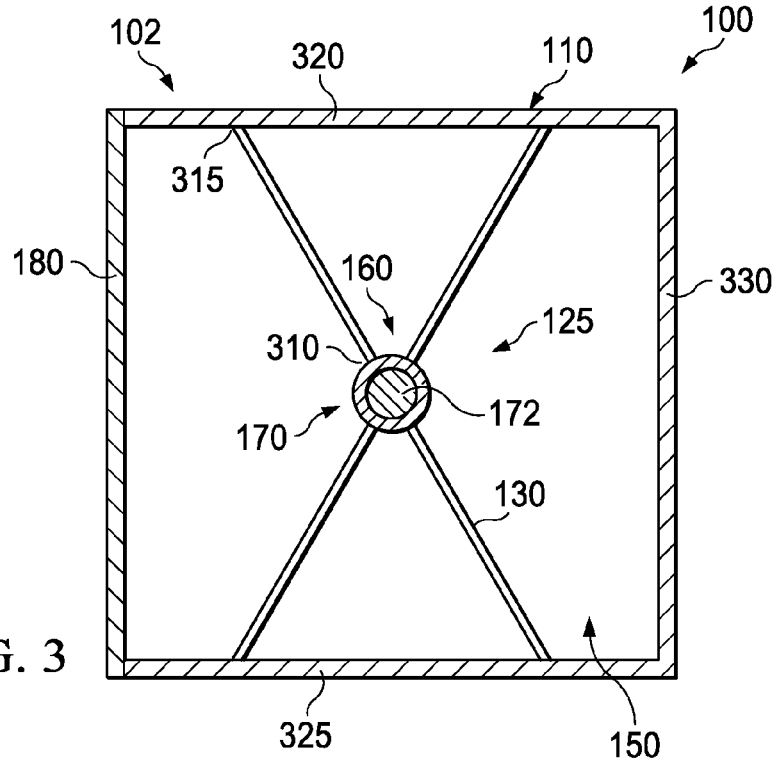
FIG. 3 presents a cross-sectional view of the example system presented in FIG. 1, along view line 3-3.
Figure 4:
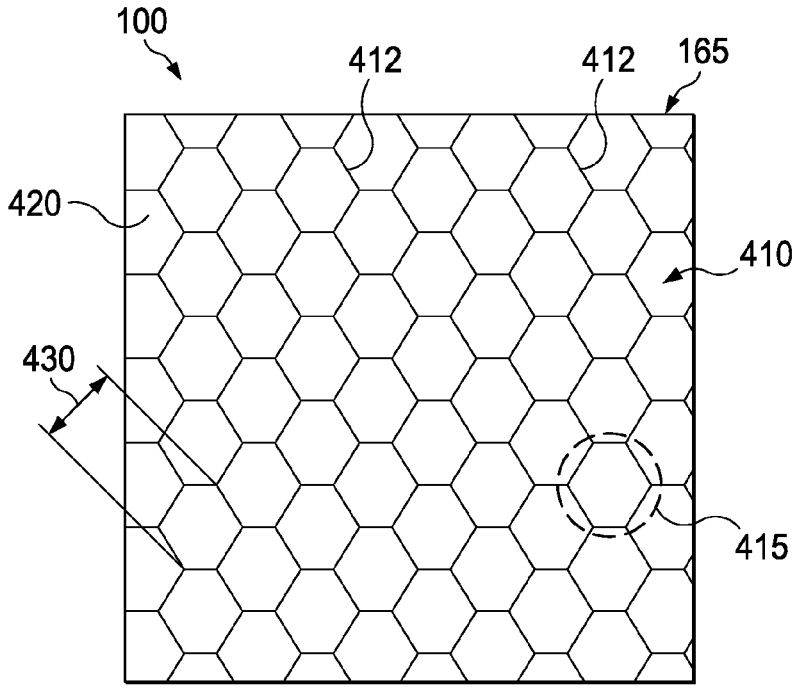
FIG. 4 presents a cross-sectional view of portion of an acoustic filter media of the example system presented in FIG. 1, along view line 4-4.

FIG. 2 presents a cross-sectional view of the example system presented in FIG. 1, along view line 2-2. FIG. 3 presents a cross-sectional view of the example system presented in FIG. 1, along view line 3-3. FIG. 4 presents a cross-sectional view of portion of an acoustic filter media of the example system presented in FIG. 1, along view line 4-4.

With continuous reference to FIGS. 1-4 throughout, the heating or cooling system 100 comprises duct assembly 102. In some cases the duct assembly 102 includes a fan housing portion 105 and a noise-control housing portion 110.

The duct assembly 102 (e.g., in a fan housing portion 105) holds a powered fan 115 that generates acoustic noise when blowing air. In some embodiments, the powered fan 115 is a part of a blower assemble 117 of the system 100 which is configured as a HVAC system. In other embodiments, the powered fan 115 is included in a evaporator assembly 117 of the system 100 which is configured as a refrigeration system. The fan 115 can have any number of conventional fan configurations, including axial, radial or centrifugal fans.

In some cases the noise-control housing portion 110 is coupled to an opening 120 in the fan housing portion 105. The duct assembly 102 (e.g., in a noise-control housing portion 110) holds an acoustic wave modulator 125 having one or more fins 130. The acoustic wave modulator 125 is configured to reduce turbulence of the air traveling through the duct assembly 102.

The term air turbulence, as used herein, refers to the acoustic modal structure of the frequency of the air moving in a direction 135 in the duct assembly 102 (e.g., between the fan housing 105 and noise-control housing 110). Reducing the air turbulence is synonymous with reducing the acoustic modal structure of the frequency of the air, which in turn, reduces the acoustic noise generated by the powered fan 115 when blowing air. One of ordinary skill in the art would be familiar with conventional techniques to measure modal structures. For example, one of ordinary skill would be familiar with the use of multipoint analysis, e.g., using multi-array microphones, velocimetry, and coherent analysis of measured velocity structures, to quantify a reduction in acoustic modal structures.

Embodiments of the present disclosure facilitate acoustic noise reduction through the use of the acoustic wave modulator 125 to reduce swirling vortexes of air generated in the vicinity of the powered fan 115, and, thereby reduce turbulence associated with acoustic noise generated by the fan 115. It is desirable for the acoustic wave modulator 125 to be in the vicinity of the fan 115 to mitigate the swirling vortexes. In particular, having the one or more the modulator 125 and its fins 130 within a certain distance from the fan 115 helps to optimally modify air flow to travel in one direction 135 without having cross-flow components (e.g., air flow perpendicular to the direction 135 between the fan housing 105 and noise-control housing 110. For instance, in some preferred embodiments, a gap distance 205 (FIG. 2) between the acoustic wave modulator 125 and the powered fan 115 is 1/n times a largest dimension 140 of the opening 120 in the duct assembly 102, where n equals 1 or greater. For instance, in some embodiments, such as when the opening 120 has a height 142 of 17 inches and width 144 of 17 inches, the largest dimension 140 (e.g., the diagonal distance such as shown in FIG. 1, or, in other embodiments with a circular opening 120, a diameter) equals about 24 inches and therefore the gap 205 preferably equals 24 inches or less.

In some cases, it is desirable for the gap 205 to be within a narrower range than set forth above. For instance, in some cases, separating the modulator 125 and the fan 115 by a minimum gap 205 can advantageously mitigate mechanical vibrations being transmitted from the fan 115 to components of the modulator 125 and thereby cause additional acoustic noise. For instance, in some cases, it is desirable for the modulator 125 and the fan 115 to be separated by a maximal gap 205 to optimally reduce the swirling vortexes, and hence, optimally reduce acoustic noise.

In some embodiments, for example, n is in a range from 2 to 4. Continuing with the above example, where the largest dimension 140 equals about 24 inches, the gap 205 can preferably be in a range from about 12 to about 6 inches.

As illustrated in FIG. 1, in some embodiments of the duct assembly 102, a noise-control housing portion 110 is adapted to couple to the fan housing portion 105. For instance, the noise-control housing portion 110 can have an opening 150 whose shape (e.g., a square, rectangular or circular shaped openings 150) is adapted to couple to a similarly-shaped opening 120 in the fan housing portion 105. The coupling between the two housings 105, 110 preferably forms an air-tight coupling such that the blown air substantially does not escape from an interface 210 between the two housings 105, 110. One of ordinary skill in the art would be familiar with processes to achieve such an appropriate air-tight interface 210, using techniques such as riveting, welding, adhesive taping or similar processes.

In some embodiments of the duct assembly 102, the fan housing portion 105 and the noise-control housing portion 110 are part of the same portion of the duct assembly 102. The duct assembly 102 can be configured to transfer air blown by fan 125 to an enclosed space (e.g., a room, not shown) and to return air from the enclosed space to the duct assembly 102. In other embodiments, one or both of the fan housing portion 105 or noise-control housing portion 110 can be separate inserts that are adapted to couple to each other or to be in-line with an existing duct assembly 102.

In some embodiments, the acoustic wave modulator 125 can be located on a discharge side 220 of the powered fan 115. In some embodiments, the acoustic wave modulator 125 can be located on a suction side 225 of the powered fan 115. In still other embodiments, there can be a plurality of the acoustic wave modulators 125 located on one or both the discharge and suction sides 220, 225 of the powered fan 115.

In some embodiments, each of the one or more fins 130 includes, or is, a flat slat having a long axis 230 that is substantially perpendicular (e.g., 90±20 degrees) to the direction 135 of the air flowing through the duct assembly 102 (e.g., noise-control housing portion 110) and a short axis 235 that is substantially parallel (e.g., 180±20 degrees) to the direction 135 of air flow. Such configurations facilitate straightening of the air flow to conform with the opening 150, and by doing so, helps to reduce cross-swirling air flow within the housing 110. The fins 130 thereby facilitate the breakup of the acoustic modal structures of the air.

In some embodiments, the acoustic wave modulator 125 can include a cylindrical structure 160 having a long axis 240 that is substantially parallel to the direction 135 of the air traveling through the duct assembly (e.g., noise-control housing portion 110). In some case, the cylindrical structure 160 can serve as a hub to which one or more the fins 130 are attached. Such configurations facilitate straightening the air flow. For instance, as shown in FIG. 3, one end 310 of each of the one or more fins 130 can be attached to the cylindrical structure 160 and another end 315 the one or more fins 130 can be attached to a wall 320 of the duct assembly 102 (e.g., noise-control housing portion 110). In some preferred embodiments, the fins 130 can be symmetrically distributed around the cylindrical structure 160, which is centrally located in the noise-control housing's opening 150. In other cases, however, the fins 130 are not symmetrically distributed around the cylindrical structure 160 and the cylindrical structure 160 is not centrally located in the opening 150. In still other cases, one end 315 of the fin 130 can be attached to a wall 320 while the other end 310 is free standing, attached to another wall 325, 330, or, attached to another fin 130.

Some embodiments of the system further include one or more acoustic filter media. For example, as illustrated in FIG. 1, in some embodiments, the duct assembly 102 (e.g., fan housing portion 105 or noise-control housing portion 110) further includes an acoustic filter media 165. In some cases, the acoustic filter media 165 is removably held in the fan housing portion 105 or noise-control housing portion 110 of the assembly 102. The acoustic filter media 165 can be configured such that the air traveling through the duct assembly 102 also travels through the acoustic filter media 165. The acoustic filter media 165 can be located closer to the fan 115 than the acoustic wave modulator 125, or, as shown in FIGS. 1 and 2, farther from the fan 115 than the acoustic wave modulator 125, e.g., between the fan 115 and the acoustic wave modulator 125.

The acoustic filter media 165 facilitates the further reduction in the acoustic noise. For instance, the acoustic filter media 165 can alter the acoustic noise waves to be more planar with the direction 135 of the air flow. For instance, some embodiments of the acoustic filter media 165 can be particularly effective at reducing high frequency acoustic noise (e.g., about 2000 Hz or greater).

As illustrated in FIG. 4, in some embodiments, the acoustic filter media 165 includes a pattern 410 of open-celled structures 415. As also illustrated, the open-celled structures 415 can be interconnected, such that walls 412 of one cell are shared with one or more other cells.

In some cases, to reduce resistance to air flow, openings 420 in the open-celled structures 415 are oriented substantially parallel (e.g., 180±20 degrees) to the direction 135 of the air traveling through the duct assembly 102 (e.g., fan housing portion 105 or noise-control housing portion 110). In other embodiment, the opening 420 can be oriented substantially perpendicular (e.g., 90±20 degrees) to the direction 135.

In some embodiments, introducing the acoustic filter media 165 into the noise-control housing portion 110 causes an about 0.3 inches or less decrease in water pressure when air flow from the fan 115 is about 500 cubic feet per min. For instance, in some cases, introducing the acoustic filter media 165 into the noise-control housing portion 110 causes a less than about 3 percent decrease in the powered fan's 115 performance (e.g., as measured by increased power consumption).

As illustrated in FIG. 4, the pattern 410 of open-celled structures 415 can be a honeycomb pattern of hexagonally shaped open cell-structures 415, although other shapes (e.g., triangular or square) can be used, alone or in combination with other shapes.

In some embodiments, each of the openings 420 in the pattern 410 have a maximum gap distance 430 in a range of about 1/16 inches to 1 inch. For instance, in some preferred embodiments, each of the openings 420 has a maximum gap distance 430 of about 1/16 inches, about 1/8 inches, about 1/4 inches, or, about 1/2 inches. In other cases, however, the pattern 410 could include open-celled structures 415 having differently sized openings 420.

In some embodiments, the acoustic filter media 165 includes chemical or particle filtration device. For instance, in some cases the acoustic filter media 165 can include a titanium dioxide filter device or similar materials to facilitate photocatalytic oxidation as part of a process for removing and destroying air pollutants. In some cases, a honeycomb material can be coated with a chemical or particle filtration device that includes an adsorbent or absorbent material or a catalyst (e.g., $TiO_2$). In some cases, the chemical or particle filtration device can include a particulate filter such as a pleated filter. In some such embodiments, the acoustic filter media 165 that includes the chemical or particle filtration device is preferably located on a suction side of the fan housing 105.

In some embodiments, the system further includes one or more active noise control devices. For example, as further illustrated in FIGS. 1-3, the duct assembly 102 (e.g., the noise-control housing portion 110) can also include an active noise control device 170 held therein. The active noise device 170 is configured to generate acoustic waves of equal magnitude but opposite phase as the acoustic noise to thereby reduce acoustic noise exiting the housing 110 via noise cancellation. One of ordinary skill in the art would be familiar with the implementation of such procedures in, e.g., a digital signal processor (DSP) or application specific integrated circuit (ASIC). The air that passes through the duct assembly 102 contacts a sound generating component 172 of the device 170 that can generate the acoustic waves of equal magnitude but opposite phase (e.g., as determined by a DSP or ASIC in communication with the component 172) and thereby cancel the acoustic noise waves. For example, some embodiments of the active noise device 170 include an electrically powered speaker component 172, although other embodiments could include other types of sound generating components, such as strings or membranes. Embodiments the sound generating components 172 could be perpendicular or parallel to the direction 135 of air flow.

In some embodiments, a sound generating component 172 of the active noise control device 170 is attached to the acoustic wave modulator 125. For instance, in some cases, as shown in FIGS. 1-3, a speaker 172 can be integrated into the cylindrical structure 160 of the modulator 125. In other cases, a speaker 172 of the active noise control device 170 can be attached to a wall 182 of the duct assembly 102, such as a wall portion 244, 246 of the noise-control housing portion 110 (FIG. 2), or, to a door 180 of the noise-control housing portion 110, or a door 184 of the fan housing portion 105 of the duct assembly 102.

In some embodiments, the presence of the acoustic filter media 165 synergistically enhances the active noise control device's 170 ability to more efficiently cancel the acoustic noise. That is, the combination of the acoustic filter media 165 and the active noise control device 170 can reduce noise to a greater amount as compared to a sum of the noise reductions obtained for embodiment where these components 165, 170 are individually included in the noise-control housing 110.

Figure 5:
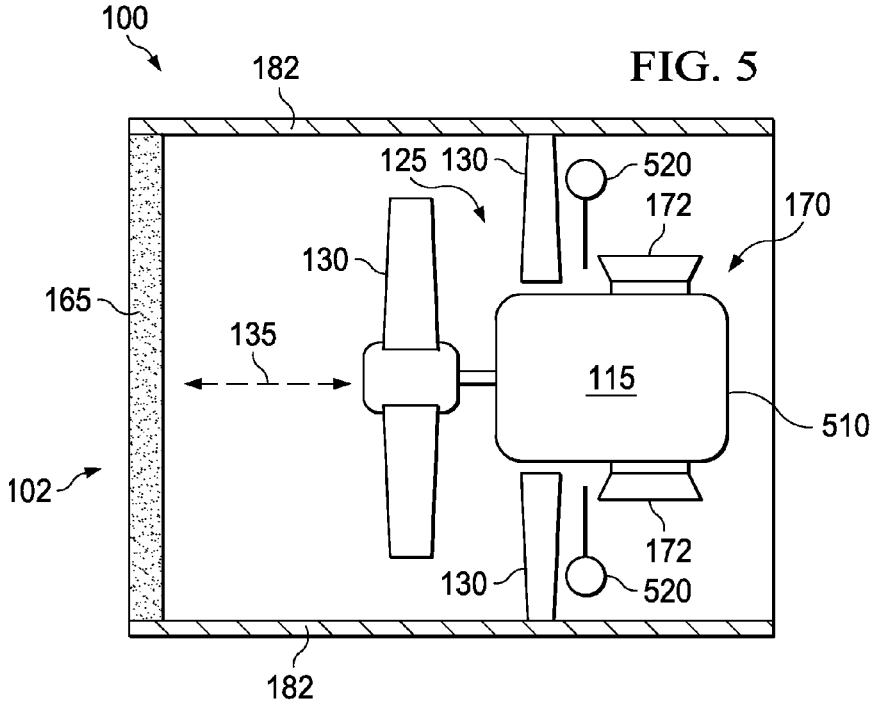
FIG. 5 presents a plan view of an alternative example embodiment of the heating or cooling system of the disclosure, from a view analogous to view 5 shown in FIG. 1.

FIG. 5 presents a plan view of an alternative example embodiment of the heating or cooling system 100 of the disclosure, from a view analogous to view 5 shown in FIG. 1. For clarity, only a portion of an upper wall 182 of the duct assembly 102 is depicted. In the example embodiment depicted in FIG. 5, the duct assembly 102 does not have separate fan housing and noise-control housing portions 105, 110 (or equivalently, the fan housing and noise-control housing portions 105, 110 correspond to same portions of the duct assembly 102).

The example system 100 depicted in FIG. 5 further includes one or more acoustic media 165 and one or more active noise control devices 170. For instance, as illustrated, the acoustic media 165 can be part of a wall 184 of the duct assembly 102, or, held in the duct assembly 102, similar to that shown in FIG. 1. For instance, as further illustrated, one or more sound generating components 172 of the active noise control device 170 can be coupled to the powered fan 115, here depicted as a radial fan. For instance, one or more sound generating components 172 embodied as a speaker can be integrated into the housing 510 of the powered fan 115. The active noise control device 170 can further include one or more microphones 520 to record the acoustic noise, e.g., as part of a procedure to generate acoustic waves to cancel the acoustic noise. The one or more microphones 520 can be coupled to the duct assembly 102, or to the powered fan 115.

Figure 6:
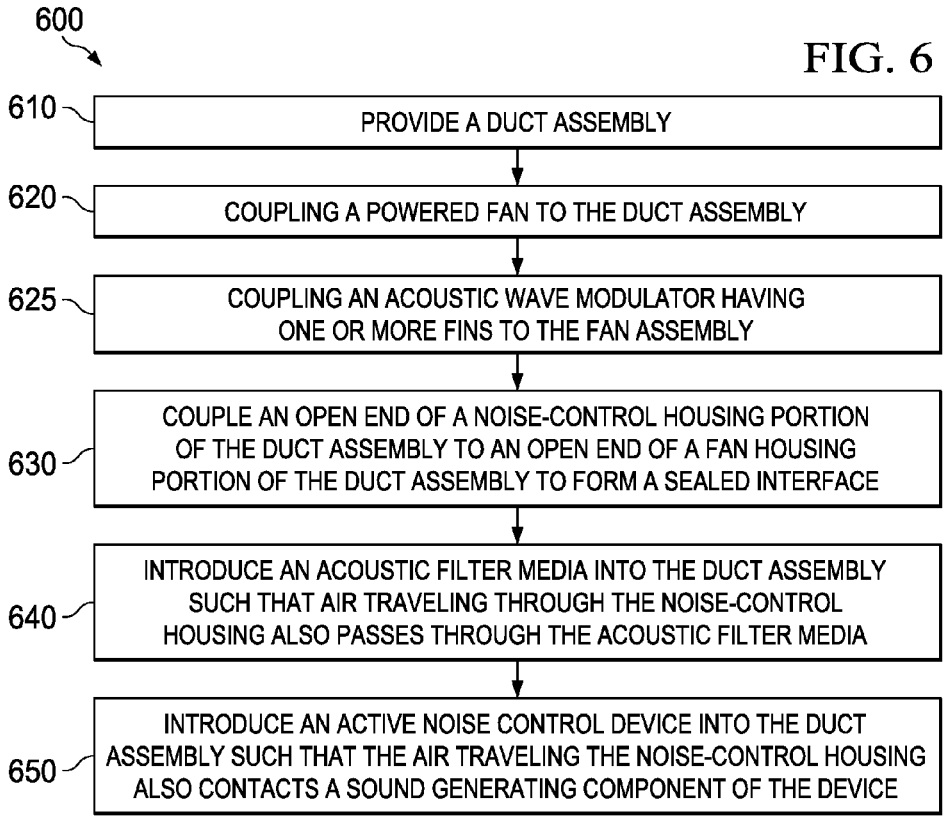
FIG. 6 presents a flow diagram of an example method of manufacturing a heating or cooling system of the disclosure, such as any of the heating or cooling systems depicted in FIGS. 1-5.

Another embodiment of the present disclosure is a method of manufacturing a heating or cooling system. FIG. 6 presents a flow diagram of an example method 600 of manufacturing a heating or cooling system of the disclosure, such as any of the embodiments of the heating or cooling systems 100 discussed in the context of FIGS. 1-5, certain components of which are referred to throughout below.

The method 600 comprises a step 610 of providing a duct assembly 102 (including, e.g., providing a fan housing portion 105 and a noise-control housing portion 110 in some cases) that holds a powered fan 115 which generates acoustic noise when blowing air. The method 600 also comprises a step 620 of coupling a powered fan to the duct assembly 102 (e.g., to the fan housing portion 105), and, a step 625 of coupling an acoustic wave modulator 125 having one or more fins 130 to the duct assembly 102 (e.g., the noise-control housing portion 110). For instance the coupling steps 620, 625 can include welding, bolting, gluing or other coupling process familiar to those of ordinary skill in the art. As discussed in the context of FIGS. 1-5, the powered fan 115 generates acoustic noise when blowing air and the acoustic wave modulator 125 is configured to reduce the turbulence of the air travelling through the duct assembly 102, thereby reducing the acoustic noise.

Some embodiments of the method 600 further comprises a step 630 of coupling an open end 120 of a noise-control housing portion 110 of the assembly 102 to an open end 150 of a fan housing portion 105 of the assembly 102 to form a sealed interface 210 such that air substantially does not escape from the interface 210.

Some embodiments of the method 600 further include a step 640 of introducing one or more acoustic filter media 165 into the duct assembly 102 (e.g., fan housing or noise-control housing portioned 105, 110) such that air traveling through the assembly 102 also passes through the acoustic filter media 165. Some embodiments of the method 600 can also include a step 650 of introducing one or more active noise control devices 170 into duct assembly 102 (e.g., fan house or noise-control housing portioned 105, 110) such that the air traveling through the noise-control housing also contacts a sound generating component 172 (e.g., a speaker) of the one or more active noise control devices 170.

Figure 7:
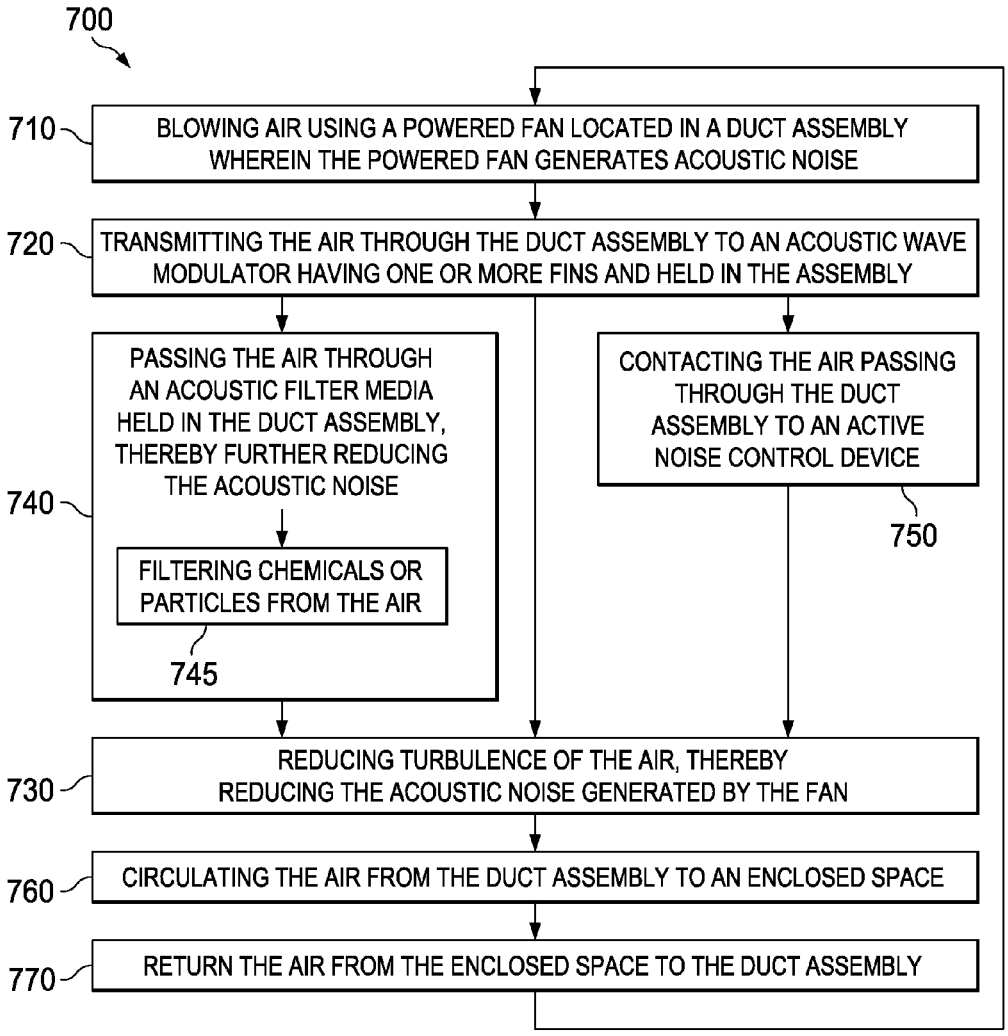
FIG. 7 presents a flow diagram of an example method of using an heating or cooling system of the disclosure, such as any of the heating or cooling systems depicted in FIGS. 1-5.

Another embodiment of the present disclosure is a method of using a heating or cooling system. FIG. 7 presents a flow diagram of an example method 700 of using a system of the disclosure, such as the systems 100 and their component parts, discussed in the context of FIGS. 1-5, components of which are referred to throughout below.

The method 700 comprises a step 710 of blowing air using a powered fan 115 held in a duct assembly 102, wherein the powered fan 115 generates acoustic noise. The method 700 further comprises a step 720 of transmitting the air through the duct assembly 102 to an acoustic wave modulator 125 having one or more fins 130 also held in the duct assembly 102. The method 700 also comprises a step 730 of reducing turbulence of the air, thereby reducing the acoustic noise generated by the fan 115.

Some embodiments of the method 700 further include a step 740 of passing the air through an acoustic filter media 165 held in the duct assembly 102, thereby further reducing the acoustic noise. In some cases, passing the air through the acoustic filter media 165 in step 740 also includes a step 745 of filtering chemicals or particles from the air.

Some embodiments of the method 700 further include a step 750 of contacting the air passing through the duct assembly 102 to an active noise control device 170, the active noise control device 170 configured to generate acoustic waves being of equal magnitude but opposite phase of the wave of the acoustic noise, thereby further reducing the acoustic noise.

Some embodiments of the method 700 can further include a step 760 of circulating the air from the duct assembly 102 to an enclosed space (e.g., a room or refrigerated space), and a step 770 of returning air from the enclosed space to the duct assembly 102.

Figure 8:
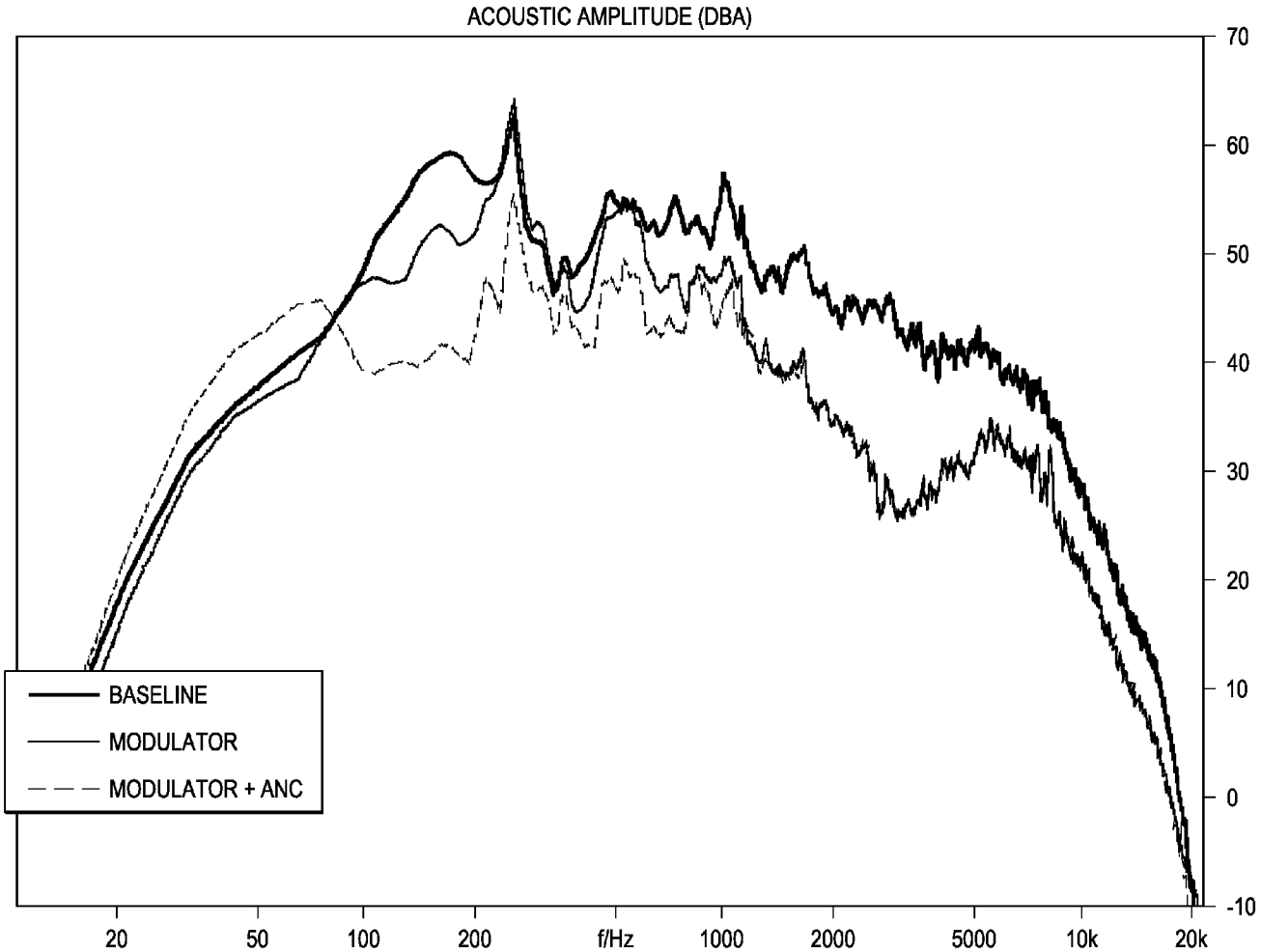
FIG. 8 presents example the noise reduction results obtained for an example system of the disclosure similar to the example system presented in FIG. 1.

FIG. 8 presents example noise reduction results obtained for an example system 100 of the disclosure such as used in accordance with the method 700. The example system 100 comprises the acoustic wave modulator 125 configured similar to that shown in FIG. 1 and including an active noise control device 170 (e.g., a Silentium S-Cube Kit, Silentium Ltd. Rehovot Israel) both held in a noise control housing portion 110 of a duct assembly 102 having a 12 inch width and 12 inch height. The active noise control device 170 included a 6 inch diameter speaker 172 attached to the centrally located cylindrical structure 160 of the modulator 125 such as shown in FIG. 1. A single reference microphone was used to acquire the necessary data for the calculation of the acoustic wave signal of equal magnitude but opposite phase to the wave of the acoustic noise.

FIG. 8 presents acoustic profiles, as plots of acoustic noise dB(A) versus frequency (Hz), for the example system 100 under three different operating conditions. "Baseline" shows an example acoustic profile of the system 100 with the fan 115 held in its housing portion 105, powered on, and blowing air in accordance with step 710.

"Modulator" shows an example acoustic profile with the acoustic wave modulator 125 in its housing 110 coupled to the fan housing 105 so that air can be transmitted to the noise-control housing 110 in accordance with step 720 and reduce air turbulence in accordance with step 730.

The fan 115 was powered on and operating at the same speed as for "Baseline" (e.g., a speed in a range from about 1000 to 2000 cubic feet per minute). "Modulator+ANC" shows an example acoustic profile obtained using the same configuration as for the "Modulator" except that the active noise control device 170 was operating in accordance with step 750.

In the example presented in FIG. 8, the acoustic noise reduction from "Baseline" compared to "Modulator" was about 4 dB(A) and the acoustic noise reduction from "Baseline" compared to "Modulator +ANC" was about 9 dB(A).

Those skilled in the art to which this application relates will appreciate that other and further additions, deletions, substitutions and modifications may be made to the described embodiments.

What is claimed is:

1. A heating or cooling system, comprising a powered fan held in a duct assembly, wherein said powered fan generates acoustic noise when blowing air; and an acoustic wave modulator held in said duct assembly, said acoustic wave modulator having one or more fins and configured to reduce turbulence of said air traveling through said duct assembly, wherein a gap between said acoustic wave modulator and said fan is 1/n times a largest cross-sectional dimension of an opening in said duct assembly, where n is 1 or greater.

2. The system of claim 1, wherein said acoustic wave modulator is located on a one of a discharge side or a suction side of said powered fan.

3. The system of claim 1, wherein said duct assembly includes a noise-control housing portion and a fan housing portion, said noise-control housing portion coupled to an opening of said fan housing portion.

4. The system of claim 1, wherein each of said one or more fins includes a flat slat having a long axis that is substantially perpendicular to a direction of said air flowing through said duct assembly and a short axis that is substantially parallel to said direction.

5. The system of claim 1, wherein said acoustic wave modulator includes a cylindrical structure having long axis that is substantially parallel to a direction of said air traveling through said duct assembly.

6. The system of claim 5, wherein one end of each of said one or more fins is attached to said cylindrical structure and another end said one or more fins is attached to a wall of said duct assembly.

7. The system of claim 1, further including one or more acoustic filter media, said acoustic filter media configured such that said air traveling through said duct assembly also travels through said acoustic filter media.

8. The system of claim 7, wherein said acoustic filter media includes a pattern of open-celled structures, openings in said pattern oriented substantially parallel to a direction of said air traveling through said noise-control housing.

9. The system of claim 7, wherein said acoustic filter media is part of a wall of said duct assembly.

10. The system of claim 7, wherein said acoustic filter media includes a chemical or particle filtration device.

11. The system of claim 7, wherein said acoustic filter media is located between said powered fan and said acoustic wave modulator.

12. The system of claim 1, further including one or more active noise control devices, said active noise devices configured to generate acoustic waves of equal magnitude but opposite phase as said acoustic noise.

13. The system of claim 1, wherein one or more sound generating components of said active noise control device are coupled to one or more of a wall or door of said duct assembly.

14. The system of claim 1, wherein one or more sound generating components of said active noise control devices are coupled to said acoustic wave modulator or to said powered fan.

15. The system of claim 1, wherein said heating or cooling system is a heating, ventilating and air conditioning (HVAC) system and said powered fan is included in a blower assembly of said HVAC system.

16. The system of claim 1, wherein said heating or cooling system is a refrigeration system and said powered fan is included in an evaporator assembly of said refrigeration system.

17. A method of manufacturing a heating or cooling system, comprising:

providing a duct assembly;

coupling a powered fan to said duct assembly, wherein said powered fan generates acoustic noise when blowing air;

coupling an acoustic wave modulator having one or more fins to said duct assembly, wherein said acoustic wave modulator is configured to reduce turbulence of said air traveling through said duct assembly and a gap between said acoustic wave modulator and said fan is 1/n times a largest cross-sectional dimension of an opening in said duct assembly, where n is 1 or greater.

18. A method of using a heating or cooling system, comprising:

blowing air using a powered fan held in a duct assembly, wherein said powered fan generates acoustic noise;

transmitting said air through said duct assembly to an acoustic wave modulator held in said duct assembly, said acoustic wave modulator having one or more fins, and wherein a gap between said acoustic wave modulator and said fan is 1/n times a largest cross-sectional dimension of an opening in said duct assembly, where n is 1 or greater; and reducing turbulence of said air thereby reducing said acoustic noise.

19. The method of claim 18, wherein said acoustic noise is reduced by at least about 4 dB(A).

* * * * *